US007153101B2

(12) United States Patent
Mansson

(10) Patent No.: US 7,153,101 B2
(45) Date of Patent: Dec. 26, 2006

(54) PULLING MARINE PROPELLER

(75) Inventor: Staffan Mansson, Myggenas (SE)

(73) Assignee: AB Volvo Penta, Göteborg (SE)

( * ) Notice: Subject to any disclaimer, the term of this patent is extended or adjusted under 35 U.S.C. 154(b) by 0 days.

(21) Appl. No.: 10/905,299

(22) Filed: Dec. 25, 2004

(65) Prior Publication Data

US 2005/0084382 A1 Apr. 21, 2005

Related U.S. Application Data

(63) Continuation of application No. PCT/SE03/00777, filed on May 13, 2003, now abandoned.

(30) Foreign Application Priority Data

Jun. 25, 2002 (SE) ..... 0201962

(51) Int. Cl.
*B63H 1/20* (2006.01)

(52) U.S. Cl. ..... 416/93 A; 416/129; 416/244 B; 440/49; 440/80; 440/81

(58) Field of Classification Search ..... 416/129, 416/93 A, 146 A, 128, 174, 244 B, 245 A; 440/80, 81, 49
See application file for complete search history.

(56) References Cited

U.S. PATENT DOCUMENTS

| | | | | |
|---|---|---|---|---|
| 1,813,552 | A * | 7/1931 | Stechauner | 416/129 |
| 3,175,530 | A * | 3/1965 | Petterson | 440/57 |
| 3,938,464 | A * | 2/1976 | Gill | 440/80 |
| 4,436,514 | A * | 3/1984 | Takahashi et al. | 440/89 R |
| 4,701,151 | A * | 10/1987 | Uehara | 464/89 |
| 4,911,663 | A * | 3/1990 | Meier | 440/49 |
| 6,599,159 | B1 * | 7/2003 | Hedlund et al. | 440/81 |
| 6,835,047 | B1 * | 12/2004 | Gerlach et al. | 416/174 |

FOREIGN PATENT DOCUMENTS

| | | | |
|---|---|---|---|
| DE | 003519599 | A1 | 1/1986 |
| EP | 0269272 | A1 | 6/1988 |
| WO | WO 0058151 | A1 | 10/2000 |

* cited by examiner

*Primary Examiner*—Edward K. Look
*Assistant Examiner*—Nathan Wiehe
(74) *Attorney, Agent, or Firm*—Novak Druce & Quigg, LLP

(57) ABSTRACT

A pulling marine propeller (1) including multiple propeller blades (4) attached to a propeller hub (5). The propeller hub (5) is attachable to a propeller shaft (9) extending from a drive housing (10) located downstream of the propeller (1). The invention is especially characterized by the fact that the propeller hub (5) is provided with an annular, radially outwardly flared peripheral portion (11) at an aft end (12) thereof. The flared portion (11) is arranged to axially overlap a front end shoulder portion (13) of the drive housing (10).

8 Claims, 4 Drawing Sheets

PULLING MARINE PROPELLER

CROSS-REFERENCE TO RELATED APPLICATION

The present application is a continuation patent application of International Application No. PCT/SE03/00777 filed 13 May 2003 now abandoned which was published in English pursuant to Article 21(2) of the Patent Cooperation Treaty, and which claims priority to Swedish Application No. 0201962-8 filed 25 Jun. 2002. Said applications are expressly incorporated herein by reference in their entireties.

TECHNICAL FIELD

The present invention relates to a pulling marine propeller that includes multiple propeller blades attached to a propeller hub, and the propeller hub is attachable to a propeller shaft extending from a drive housing located downstream of the propeller.

BACKGROUND OF THE INVENTION

In marine propulsion drives, an outer radial sealing ring is normally applied on the propeller shaft for preventing sea water from entering the drive housing. An inner radial sealing ring is also applied for preventing transmission lubricants from leaking out into the water. The radial sealing rings traditionally comprise lips which respond to external water pressure by pressing harder against the propeller shaft. In this way excessive external pressure on the sealing ring results in largely increased frictional wear of the sealing ring, which in turn may lead to undesired leakage of sea water into the drive housing.

In drives with pulling propellers, the submerged drive housing is often broader than the propeller hub. Consequently, a front end shoulder portion on the drive housing is formed at the transition between the hub and the housing. As water flows downstream along the periphery of the propeller hub, a significant dynamic pressure build-up is created locally as water is forced to deflect radially outwards past the shoulder portion of the drive housing, especially at high speed.

A problem with known pulling propeller drive designs is that this sharply increased pressure at the transition is also felt by the pressure sensitive outer radial sealing ring, leading to rapid wear of the ring and eventually, leakage.

SUMMARY OF THE INVENTION

The present invention provides a remedy to the above mentioned problem by providing a pulling marine propeller comprising (including, but not necessarily limited to) multiple propeller blades attached to a propeller hub that is attachable to a propeller shaft extending from a drive housing located downstream of the propeller. The invention is especially characterized by the fact that the propeller hub is provided with an annular, radially outwardly flared peripheral portion at its aft end, and the flared portion is arranged to axially overlap a front end shoulder portion of the drive housing.

In one advantageous embodiment of the invention, the axial cross-sectional profile of the outwardly flared peripheral portion of the propeller hub substantially corresponds to the axial cross-sectional profile of the front end shoulder portion of the drive housing.

In one embodiment of the invention, the outwardly flared peripheral portion of the propeller hub constitutes a separate aft part of the propeller hub mounted to the remaining part of the propeller hub.

Preferably, the outwardly flared peripheral portion of the propeller hub is mounted to the remaining part of the propeller hub by means of a snap lock. The snap lock comprises a radially outwardly projecting annular locking flange on a radially recessed front connection part of the outwardly flared peripheral portion. The locking flange is adapted for axially locking engagement with a corresponding annular groove formed in an axially overlapping aft connection portion of the remaining part of the propeller hub.

The outwardly flared peripheral portion is either made of plastic or another suitable material such as metal.

In an alternative embodiment of the invention, the outwardly flared peripheral portion is formed as an integral aft part of the propeller hub.

In at least one advantageous embodiment of the invention, the propeller is of the twin hub, counter-rotating type.

The shoulder portion of the drive housing exhibits a nominal cross-sectional dimension exceeding the nominal cross-sectional dimension of the propeller hub.

Other features and advantages of the invention will be described below in the description of suitable and accompanying embodiments.

BRIEF DESCRIPTION OF THE DRAWINGS

The invention will now be described in greater detail by way of example only and with reference to the attached drawings, in which.

DESCRIPTION OF PREFERRED EMBODIMENTS

Figure 1:
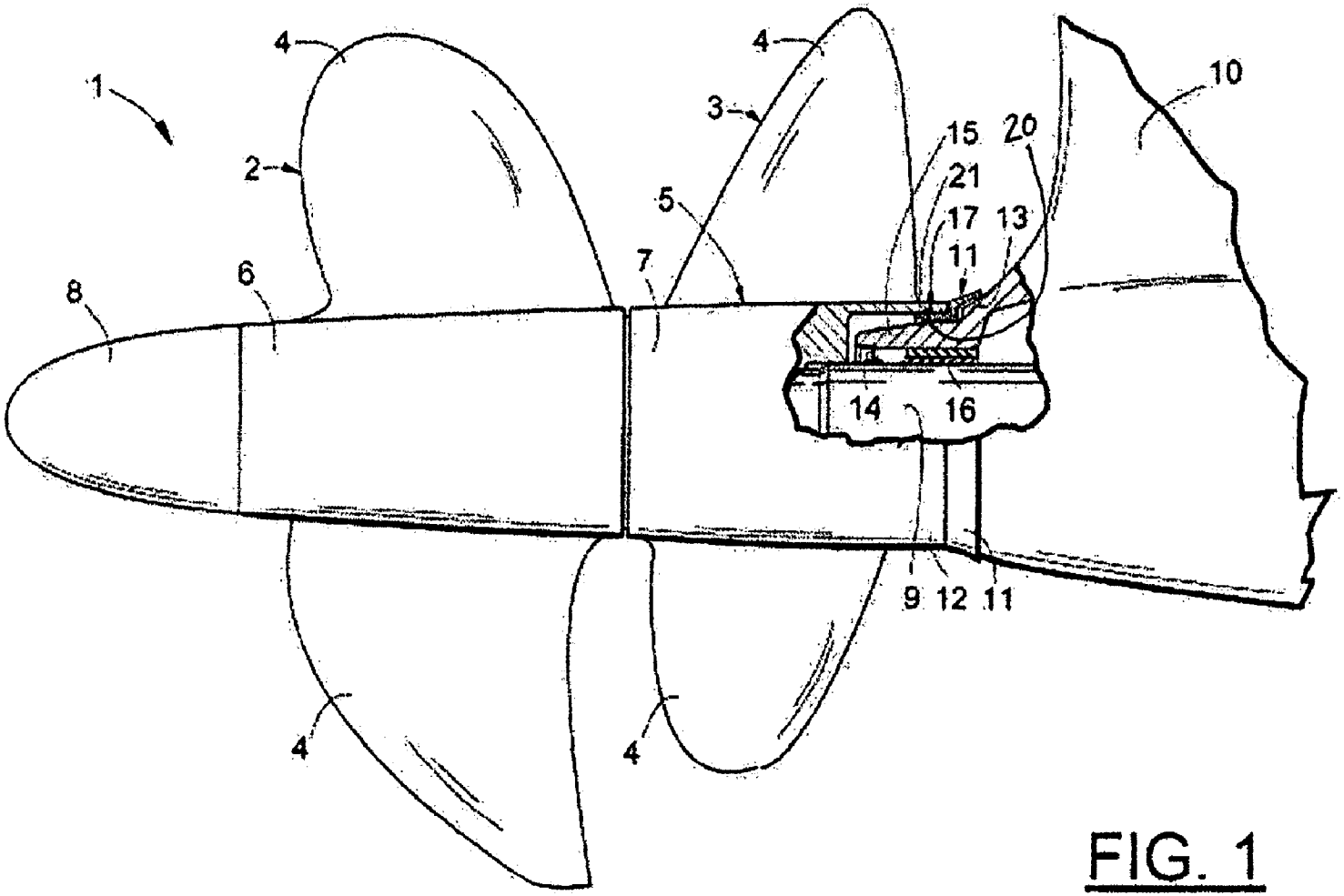
FIG. 1 shows a side view, in partial cutaway, of a twin hub, counter-rotating pulling marine propeller configured according to the teachings of a first exemplary embodiment of the invention and in which the propeller is mounted on a drive housing that is partially illustrated, and the flared portion is shown in the partial cross-sectional cutaway portion of the figure.

In FIG. 1, reference numeral 1 generally denotes a twin hub, counter-rotating pulling marine propeller configured according to a first exemplary embodiment of the presently disclosed invention. In the illustrated embodiment, the propeller 1 comprises a front propeller 2 and an aft propeller 3. However, both the front propeller 2 and the aft propeller 3 will hereinafter be collectively referred to as the propeller 1.

The propeller 1 is provided with multiple propeller blades 4 attached to a propeller hub 5. Again, since the shown example is of the twin hub, counter-rotating type, the propeller hub comprises a front hub 6 and an aft hub 7. The term propeller hub 5 will be used below as a collective term for both the front hub 6 and the aft hub 7. A spinner cone 8 is mounted immediately upstream of the propeller hub 1; i.e., to the left in FIG. 1.

The propeller 1 is attached to a propeller shaft 9 via the propeller hub 5, which propeller shaft 9 extends from a partially shown underwater drive housing 10 located downstream of the propeller 1. In a conventional manner, the propeller shaft 9 is connected to an engine via a transmission, neither of which is shown.

A novel feature of the invention is that the propeller hub 5 is provided with an annular, radially outwardly flared peripheral portion 11 at its aft end 12. The flared portion 11 is arranged in such a way as to axially overlap a front end shoulder portion 13 of the drive housing 10. The shoulder portion 13 of the drive housing 10 exhibits a nominal cross-sectional dimension exceeding the nominal cross-sectional dimension of the propeller hub 5. The term nominal cross-sectional dimension is used herein to describe a general dimensional increase in the transition between the propeller hub 5 and the drive housing 10. In the embodiment shown in FIG. 1, both the propeller hub 5 and the drive housing 10 has a generally circular cross-section in this transitional region. Thus, in this embodiment, the term nominal cross-sectional dimension means the average diameter of each part.

By providing the propeller hub 5 with a flared portion 11 overlapping the shoulder portion 13 as described above, the dynamic pressure exerted on an outer radial sealing ring 14 applied between a cylindrical collar portion 15 of the drive housing 10 and the propeller shaft 9, can be drastically reduced in comparison with known designs without such an overlapping flared portion 11. The collar portion 15 protrudes into the propeller hub 5 and also serves as a seat for a radial slide bearing 16 for the propeller shaft 9, and the slide bearing is located inside of the sealing ring 14. In one test made by the applicant at a speed of 45 knots, the dynamic pressure was decreased by two thirds in a pulling propeller with a flared portion according to the invention when compared to an otherwise corresponding conventional pulling propeller. This pressure reducing effect results in a much reduced radial pressure between the sealing ring 14 and the propeller shaft 9, which in turn means less wear and thus a prolonged expected life span of the sealing ring 14.

Further, as can clearly be seen in FIG. 1, the axial cross-sectional profile of the flared portion 11 of the propeller hub 5 substantially corresponds to the axial cross-sectional profile of the front end shoulder portion 13 of the drive housing 10.

In the above described first embodiment of the invention, the flared portion 11 constitutes a separate aft part of the propeller hub 5 mounted to the remaining part of the propeller hub 5. The thus separately formed flared portion 11 may be made of a durable plastic material for protecting the propeller hub 5 from unintentional damage during service and the like. Alternatively, the separately formed flared portion 11 may be made of other suitable materials, such as metal.

Figure 2:
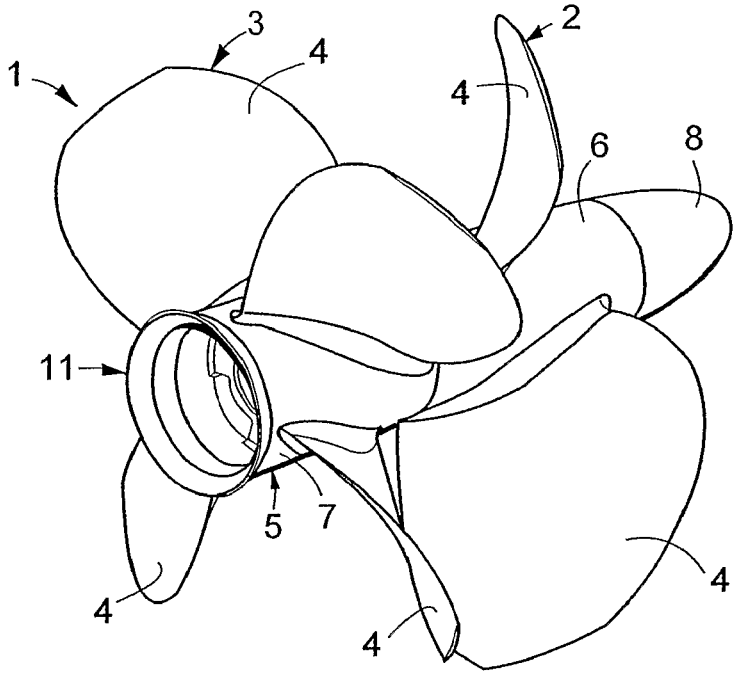
FIG. 2 shows a perspective view of the counter-rotating propeller of the first embodiment and in which the flared portion is clearly illustrated.

In FIG. 2, the separately formed annular flared portion 11 is clearly illustrated in a perspective view of the counter-rotating propeller 1 of the first embodiment.

Figure 3:
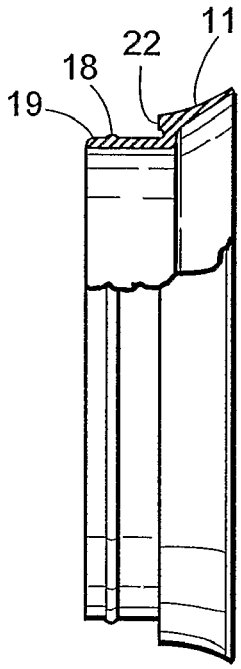
FIG. 3 shows a partial cross-sectional side view of a separately formed flared portion.

The separately formed annular flared portion 11 is detached from the propeller 1 in the enlarged side view of FIG. 3. Now, with reference both to FIGS. 1 and 3, the separately formed flared portion 11 of the propeller hub 5 is mounted to the remaining part of the propeller hub 5 by means of a snap lock 17. The snap lock 17 comprises a radially outwardly projecting annular locking flange 18 on a radially recessed front connection part 19 of the flared portion 11. The locking flange 18 is adapted for axially locking engagement with a corresponding annular groove 20 formed in an axially overlapping aft connection portion 21 of the remaining part of the propeller hub 5. As shown in FIG. 3, the separately formed flared portion 11 also exhibits an annular axial sealing surface 22 adapted to abut a corresponding surface (that is not shown) on the remaining part of the propeller hub 5.

It is contemplated that in an alternative, but which is not shown, the separately formed flared portion 11 is screwed into the remaining part of the propeller hub 5.

Figure 4:
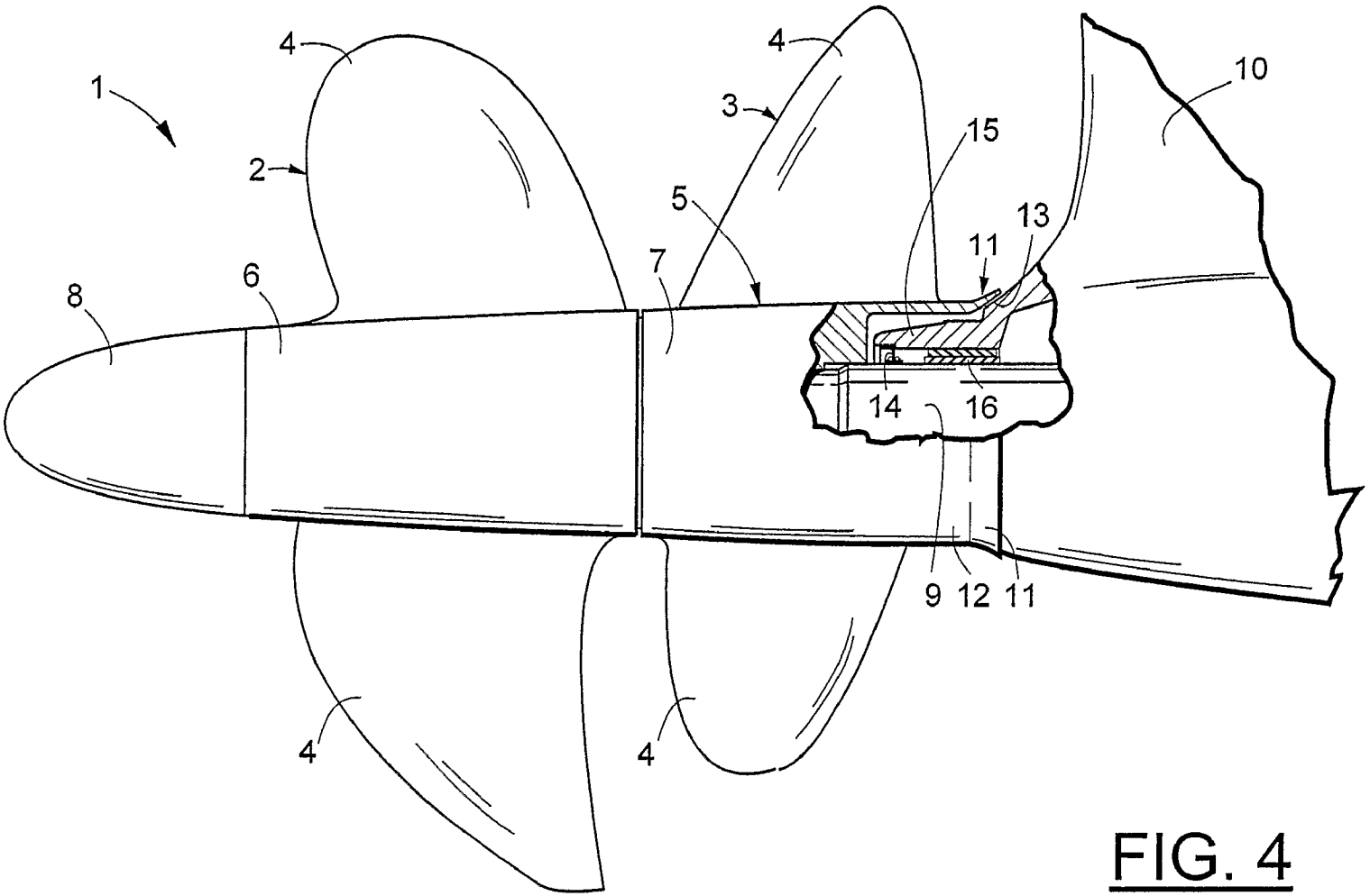
FIG. 4 shows a second exemplary embodiment of the invention in which the outwardly flared portion of the propeller hub is formed as an integral aft part of the propeller hub.
Figure 5:
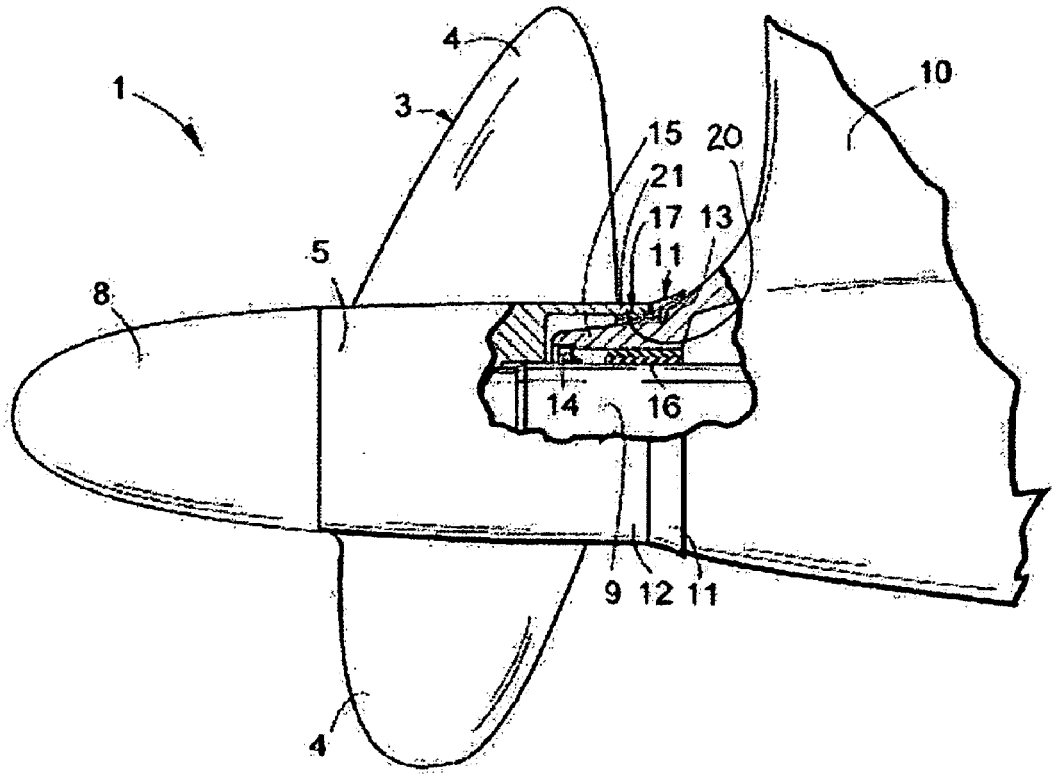
FIG. 5 depicts a third exemplary embodiment of the invention disclosing a single pulling propeller.

In a second embodiment of the invention shown in FIG. 4, the flared portion 11 is formed as an integral aft part of the propeller hub 5. According to FIG. 5, the flared portion 11 of the invention may naturally also be applied on a single pulling propeller 1.

It is to be understood that the invention is by no means limited to the embodiments described above, and may be varied freely within the scope of the appended claims.

What is claimed is:

1. A pulling marine propeller (1) comprising:

multiple propeller blades (4) attached to a propeller hub (5), said propeller hub (5) being attachable to a propeller shaft (9) extending from a drive housing (10) located downstream of the propeller (1); and said propeller hub (5) being provided with an annular, radially outwardly flared peripheral portion (11) at an aft end (12) thereof, said flared portion (11) being arranged to axially overlap a front end shoulder portion (13) of the drive housing (10).

2. The pulling marine propeller (1) as recited in claim 1, wherein an axial cross-sectional profile of said outwardly flared peripheral portion (11) of the propeller hub (5) substantially corresponds to the axial cross-sectional profile of the front end shoulder portion (13) of the drive housing (10).

3. The pulling marine propeller (1) as recited in claim 1, wherein said outwardly flared peripheral portion (11) of the propeller hub (5) constitutes a separate aft part of the propeller hub (5) mounted to the remaining part of the propeller hub (5).

4. The pulling marine propeller (1) as recited in claim 3, wherein said outwardly flared peripheral portion (11) of the propeller hub (5) is mounted to the remaining part of the propeller hub (5) by means of a snap lock (17), said snap lock (17) comprising a radially outwardly projecting annular locking flange (18) on a radially recessed front connection part (19) of the outwardly flared peripheral portion (11), said locking flange (18) being adapted for axially locking engagement with a corresponding annular groove (20) formed in an axially overlapping aft connection portion (21) of said remaining part of the propeller hub (5).

5. The pulling marine propeller (1) as recited in claim 3, wherein said outwardly flared peripheral portion (11) is made of plastic.

6. The pulling marine propeller (1) as recited in claim 1, wherein said outwardly flared peripheral portion (11) is formed as an integral aft part of the propeller hub (5).

7. The pulling marine propeller (1) as recited in claim 1, wherein said propeller (1) is of the twin hub, counter-rotating type.

8. The pulling marine propeller (1) as recited in claim 1, wherein said shoulder portion (13) of the drive housing (10) exhibits a nominal cross-sectional dimension exceeding the nominal cross-sectional dimension of the propeller hub (5).

* * * * *